United States Patent [19]

Kuo et al.

[11] 4,041,094

[45] Aug. 9, 1977

[54] METHOD FOR UPGRADING PRODUCTS OF FISCHER-TROPSCH SYNTHESIS

[75] Inventors: James C. Kuo, Cherry Hill; Charles Dwight Prater, Pitman, both of N.J.; John J. Wise, Media, Pa.

[73] Assignee: Mobil Oil Corporation, New York, N.Y.

[21] Appl. No.: 614,587

[22] Filed: Sept. 18, 1975

[51] Int. Cl.[2] ..... C07C 1/04

[52] U.S. Cl. ..... 260/676 R; 208/79; 208/88; 208/93; 208/120; 208/135; 260/449 R; 260/450

[58] Field of Search ..... 260/676, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Paterson | 208/79 |
| 3,700,585 | 10/1972 | Chen et al. | 208/111 |
| 3,729,409 | 4/1973 | Chen | 208/135 |
| 3,760,024 | 9/1973 | Cattanach | 260/673 |
| 3,843,510 | 10/1974 | Morrison et al. | 208/111 |
| 3,928,483 | 12/1975 | Chang et al. | 260/668 R |
| 3,960,978 | 6/1976 | Givens et al. | 260/683.15 R |

OTHER PUBLICATIONS

Asinger, Paraffins Chemistry & Technology, Pergammon Press, N.Y., (1968), pp. 3, 123–125, 131, 132, 136, 138.

*Primary Examiner*—C. Davis

*Attorney, Agent, or Firm*—Charles A. Huggett; Carl D. Farnsworth

[57] ABSTRACT

Upgrading of Fischer-Tropsch synthesis product is obtained by separating a 560° F minus hydrocarbon fraction from gaseous $C_5$ rich material and a water phase comprising oxygenates. Alcohols may be recovered from the water phase for conversion to gasoline boiling components. $C_5$ rich material is converted to gasoline boiling material with a ZSM-5 crystalline zeolite and upgrading of the 560° F minus hydrocarbon fraction is accomplished with a ZSM-5 crystalline zeolite catalyst.

4 Claims, 3 Drawing Figures

METHOD FOR UPGRADING PRODUCTS OF FISCHER-TROPSCH SYNTHESIS

BACKGROUND OF THE INVENTION

1. Field of the Invention

This invention is concerned with a process for converting synthesis gas, i.e., mixtures of gaseous carbon oxides with hydrogen or hydrogen donors, to hydrocarbon mixtures and oxygenates. In one aspect, this invention is concerned with process for increasing the field of hydrocarbon mixtures rich in aromatic hydrocarbons over that obtained in a know for Fischer-Tropsch Synthesis process. In still another aspect, this invention is concerned with providing a novel catalyst for improving the products obtained by the conversion of synthesis gas over the prior art catalysts.

2. Other Prior Art

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in Encyclopedia of Chemical Technology, Edited by Kirk-Othermer, Second Edition, Volume 10, pages 353–433, (1966), Interscience Publishers, New York, New York, the contents of which are herein incorporated by reference. The techniques for gasification of coal or other solid, liquid, or gaseous fuel are not considered to be per se inventive here.

It is considered desirable to effectively and more efficiently convert synthesis gas, and thereby coal and natural gas, to highly valued hydrocarbons such as motor gasoline with high octane number, petrochemical feedstocks, liquefiable petroleum fuel gas, and aromatic hydrocarbons. It is well known that synthesis gas will undergo conversion to form reduction products of carbon monoxide, such as hydrocarbons, at from about 300° F to about 850° F under from about one to one thousand atmospheres pressure, over a fairly wide variety of catalysts. The Fischer-Tropsch process, for example, which has been most extensively studied, produces a range of products including liquid hydrocarbons, a portion of which have been used as low octane gasoline. The types of catalysts that have been studied for this and related processes include those based on metals or oxides of iron, cobalt, nickel, ruthenium, thorium, rhodium and osmium.

The wide range of catalysts and catalysts modifications disclosed in the art and an equally wide range of conversion conditions for the reduction of carbon monoxide by hydrogen provide considerable flexibility toward obtaining selected boiling-range products. Nonetheless, in spite of this flexibility, it has not proved possible to make such selections so as to produce liquid hydrocarbons in the gasoline boiling range which contain highly branched paraffins and substantial quantities of aromatic hydrocarbons, both of which are required for high quality gasoline, or to selectively produce aromatic hydrocarbons particularly rich in the benzene to xylenes range. A review of the status of this art is given in "Carbon Monoxide-Hydrogen Reactions", Encyclopedia of Chemical Technology, Edited by Kirk-Othmer, Second Edition, Volume 4, pp. 446–488, Interscience Publishers, New York, N.Y., the text of which is incorporated herein by reference.

Recently, it has been discovered that synthesis gas may be converted to oxygenated organic compounds and these then converted to higher hydrocarbons, particularly high octane gasoline, by catalytic contact of the synthesis gas with a carbon monoxide reduction catalyst followed by contacting the conversion products so produced with a special class of crystalline zeolite catalyst in a separate reaction zone. This two-stage conversion is described in copending U.S. patent application, Ser. No. 387,220, filed on Aug. 9, 1973. Compositions of iron, cobalt or nickel deposited in the inner absorption regions of crystalline zeolites are described in U.S. Pat. No. 3,013,990. Attempts to convert synthesis gas over X-zeolite base exchanged with iron, cobalt and nickel are described in Erdol and Kohle - Erdgas, Petrochemie: Brennstoff - Chemie, Vol. 25, No. 4, pp. 187–188, April 1972.

SUMMARY OF THE INVENTION

This invention is concerned with improving the product distribution and yield of products obtained by a Fischer-Tropsch synthesis gas conversion process. In a particular aspect, the present invention is concerned with improving the product yield, product distribution and operating economies of a synthesis gas conversion operation known in the industry as the Sasol Synthol process.

The Sasol process located in South Africa and built to convert an abundant supply of poor quality coal and products thereof to particularly hydrocarbons, oxygenates and chemical forming components was a pioneering venture. The process complex developed is enormous, expensive to operate and may be conveniently divided or separated into (1) a synthesis gas preparation complex from coal, (2) a Fischer-Tropsch type of synthesis gas conversion in both a fixed catalyst bed operation and a fluid catalyst bed operation, (3) a product recovery operation and (4) auxillary plant and utility operations required in such a complex.

The extremely diverse nature of the products obtained in the combination operation of the Sasol process amplifies the complexity of the overall process complex, its product recovery arrangement and its operating economics. The Sasol synthesis operation is known to produce a wide spectrum of products including fuel gas, light olefins, LPG, gasoline, light and heavy fuel oils, waxy oils and oxygenates identified as alcohols, acetone, ketones and acids particularly acetic and proprionic acid. The $C_2$ and lower boiling components may be reformed to carbon monoxide and hydrogen or the $C_2$ formed hydrocarbons and methane may be combined and blended for use in a fuel gas pipeline system.

In the Sasol operation, the water soluble chemicals are recovered as by steam stripping distillation and separated into individual components with the formed organic acids remaining in the water phase separately treated. Propylene and butylene formed in the process are converted to gasoline boiling components as by polymerization in the presence of a phosphoric acid catalyst and by alkylation. Propane and butane on the other hand are used for LPG.

The present invention is concerned with improving a Fischer-Tropsch synthesis gas conversion operation and is particularly directed to improving the synthetic gasoline and light oil product selectivity and quality obtained by processing $C_5$ plus material over a special class of crystalline zeolite represented by ZSM5 crystalline zeolite. More particularly, the present invention is concerned with improving the product selectivity of a Fischer-Tropsch syngas conversion operation.

The special zeolite catalysts referred to herein utilize members of a special class of zeolites exhibiting some unusual properties. These zeolites induce profound transformations of aliphatic hydrocarbons to aromatic hydrocarbons in commercially desirable yeilds and are generally highly effective in alkylation, isomerization, disproportionation and other reactions involving aromatic hydrocarbons. Although they have usually low alumina contents, i.e. high silica to alumina ratios, they are very active even with silica to alumina ratios exceedingly 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e., they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}}{\log_{10}} \frac{\text{(fraction of n-hexane remaining)}}{\text{(fraction of 3-methylpentane remaining)}}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-desired Constraint Index is an important and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range 1 to 12.

Thus, it should be understood that the "Constraint Index" value as used is an inclusive rather than an exclusive value. That is, a zeolite when tested by any combination of conditions within the testing definition set forth herein above to have a constraint index of 1 to 12 is intended to be included in the instant catalysts definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. Application, Ser. No. 358,192, filed May 7, 1973, and now abandoned, the entire contents of which are incorporated herein by reference, describes a zeolite composition, and a method of making such, designated as ZSM-21 which is useful in this invention.

U.S. Application Ser. No. 528,061 filed Nov. 29, 1974, the entire contents of which are incorporated herein by reference, describes a zeolite composition including a method of making it. This composition is designated ZSM-35 and is useful in this invention.

U.S. Application Ser. No. 528,060, filed Nov. 29, 1974, and now abandoned, the entire contents of which are incorporated herein by reference, describes a zeolite composition including a method of making it. This composition is designated ZSM-38 and is useful in this invention.

The X-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W.M. Meier. This paper, the entire contents of which are incorporated herein by reference, is included in "Proceedings of the Conference on Molecular Sieves, London, April, 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

Figure 1:
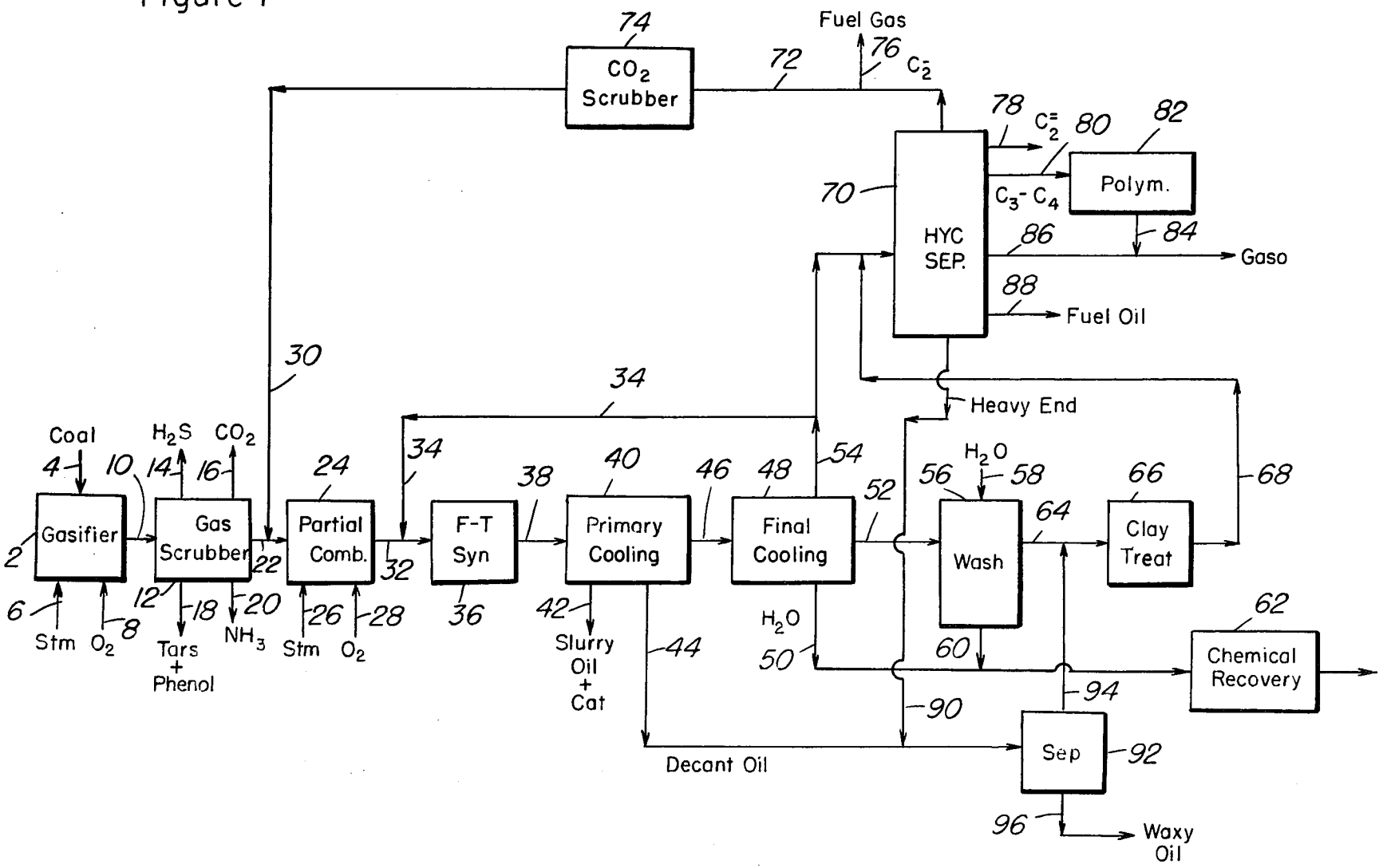
FIG. 1 is a condensed, schematic, block flow arrangement of a known Fisher-Tropsch syngas conversion process directed to the conversion of coal to synthesis gas comprising carbon monoxide and hydrogen and the reduction of carbon monoxide by the Fischer-Tropsch Process to form a product mixture comprising hydrocarbon oxygenates and the recovery of these products for further use.

Referring now to FIG. 1, there is shown in block flow arrangement a substantially reduced process flow arrangement of the Sasol syngas conversion process. A coal gasifier section 2 is provided to which pulverized coal is introduced by conduit 4, steam by conduit 6 and oxygen by conduit 8. Thr products of gasifier section 2 are then passed by conduit 10 to a gas scrubber section 12. In a scrubber section 12, carbon monoxide and hydrogen producing gases are separated from hydrogen sulfide which is removed by conduit 14, carbon dioxide removed by conduit 16, tars and phenols removed by conduit 18 and ammonia removed by condiut 20. The carbon monoxide-hydrogen producing gas is passed from section 12 by conduit 22 to a partial combustion zone 24 supplied with steam by conduit 26 and oxygen by conduit 28. Recycle $C_2$- fuel gas product of the combination process after separation of carbon dioxide therefrom is recycled by conduit 30 to the partial combustion section 24. In the partial combustion operation 24, a suitable carbon monoxide-hydrogen rich synthesis gas of desired ratio is formed for use in the downstream Fischer-Tropsch synthesis gas conversion operation.

The Sasol process operates two versions of the Fischer-Tropsch process; one being a fixed catalyst bed operation and the other being a fluid catalyst bed operation. Each of these operations use iron catalyst prepared and presented to obtain desired catalyst composition and activity. The synthesis gas prepared as above briefly identified is passed by conduit 32 to the Fischer-Tropsch reaction section 36 in admixture with recycle gas introduced by conduit 34. Generally the synthesis gas fuel is introduced at a temperature of about 160° C and at an elevated pressure of about 365 psig. The temperature of the synthesis gas admixed with catalyst in the fluid operation rapidly rises by the heat liberated so that the Fischer-Tropsch and water gas shift reactions take place. The products of the Fischer-Tropsch synthesis reaction are conveyed by conduit 38 to a primary general section 40 wherein the temperature of the mixture is reduced to within the range of 280° to about 400° F. In a primary cooling section a separation is made which permits the recovery of a slurry oil and catalyst stream by conduit 42, and a decant oil stream by conduit 44. In one typical operation, the decant oil stream will have an ASTM 95% boiling point of about 900° F. A light oil stream boiling below about 560° F and lower boiling components including oxygenates is passed by conduit 46 to a second or final cooling and separating section 48. In cooling section 48 a separation is made to recover a water phase comprising water soluble oxygenates and chemicals withdrawn by conduit 50, a relatively light hydrocarbon phase boiling below about 560° F withdrawn by conduit 52 and a normally vaporous phase withdrawn by conduit 54. A portion of the vaporous phase comprising unreacted carbon monoxide and hydrogen is recycled by condiut 34 to conduit 32 charging syngas to the Fischer-Tropsch synthesis operation. In a typical operation, about one volume of fresh feed is used with two volumes of recycle gas. The hydrocarbons do not completely condense and an absorber system is used for their recovery. Methane and $C_2$ hydrocarbons are blended with other components in a pipe line system or they are passed to a gas reforming section for recycle as feed gas in the synthesis operation. The light hydrocarbon phase in conduit 52 is then passed through a water wash section 56 provided with wash water by conduit 58. In wash section 56, water soluble materials comprising oxygenates are removed and withdrawn therefrom by conduit 60. The water phases in conduit 50 and 60 are combined and passed to a complicated and expensive to run chemicals recovery operation 62. The washed light hydrocarbon phase is removed by conduit 64 and passed to a clay treater 66 along with hydrocarbon fraction boiling below about 650° F. recovered from the decanted oil phase in conduit 44 and a heavy oil product fraction recovered as hereinafter described. The hydrocarbon phase thus recovered and passed to this clay treating section is preheated to an elevated temperature of above about 600° F or higher before contacting the catalyst or clay in the treater. This clay treatment isomerizes hydrocarbons and particularly the alpha olefins in the product thereby imparting a higher octane rating to these materials. The treatment also operates to convert harmful acids and other oxygenates retained in the hydrocarbon phase after the water wash. The clay treated hydrocarbon product is passed by conduit 68 to a hydrocarbon separation reaction 70. A portion of the hydrocarbon vapors in conduit 54 not directly recycled to the Fischer-Tropsch conversion operation by conduit 34 is also passed to the hydrocarbon separation reaction 70. In the hydrocarbon separation section 70, a separation is made to recover a fuel gas stream comprising $C_2$- hydrocarbons withdrawn by conduit 72. A portion of this material is passed through a $CO_2$ scrubber 74 before recycle by conduit 30 to the partial combustion zone 24. A portion of the fuel gas may be withdrawn by conduit 76. In separation section 70, a $C_2$ olefin rich stream is recovered by conduit 78 for chemical processing as desired. A $C_3$ to $C_4$ hydrocarbon stream rich in olefins is withdrawn by conduit 80 and passed to catalytic polymerization in section 82. Polymerized material suitable for blending with gasoline product is withdrawn by conduit 84. A gasoline product fraction is recovered by conduit 86 and a light fuel oil product such as No. 2 fuel oil is withdrawn by conduit 88. The heavy ends from separation section 70 is withdrawn by conduit 90 for admixture with the decant oil fraction in conduit 44 as mentioned above. The blend of hydrocarbon product thus formed will boil in the range of about 400° F to about 1000° F. This material blend is passed to a separator section 92 wherein a separation is made to recover a fraction boiling in the range of from about 400° to 650° F withdrawn by conduit 94 from a heavier higher boiling waxy oil withdrawn by conduit 96.

In this relatively complicated synthesis gas conversion operation and product recovery, it is not unusual to recover a product distribution comprising 2% ethylene, 8% LPG, 70% gasoline boiling material, 3% fuel oil, 3% waxy oil and about 14% of materials defined as oxygenates.

This Fischer-Tropsch synthesis operation above briefly defined and known in the industry as the Sasol synthol process can be significantly improved following the concepts of this invention. That is the light oil obtained in the process and passed to the clay treating operation as above described can be upgraded to a propane and heavier product with high yields. Furthermore, the oxygenates when retained in the light oil phase can be converted to fall in a light fuel oil or gasoline product; the $C_3$ and heavier yield is increased to 97 wt % on charge; the $C_5$ and heavier yield is 81%. However, if the isobutane produced by applicants contribution to the process is alkylated with $C_3$ to $C_4$ olefins produced, the $C_5$ and heavier yield is increased to 93 wt %. By following the processing concepts herein identified, the clear octane of the synthetic gasoline fraction is increased from 54 to 92 and the leaded octane number (R+3) goes from 69 to 99. The motor octane of the product is 83 clear and 89 leaded. The gasoline fraction ($C_5$ - 434° F) is 73.2 wt % in the charge and 68.2 wt % in the total product. This gasoline fraction also has an unleaded octane of 92. With addition of alkylates the gasoline yield can be increased to 79 weight percent.

Figure 2:
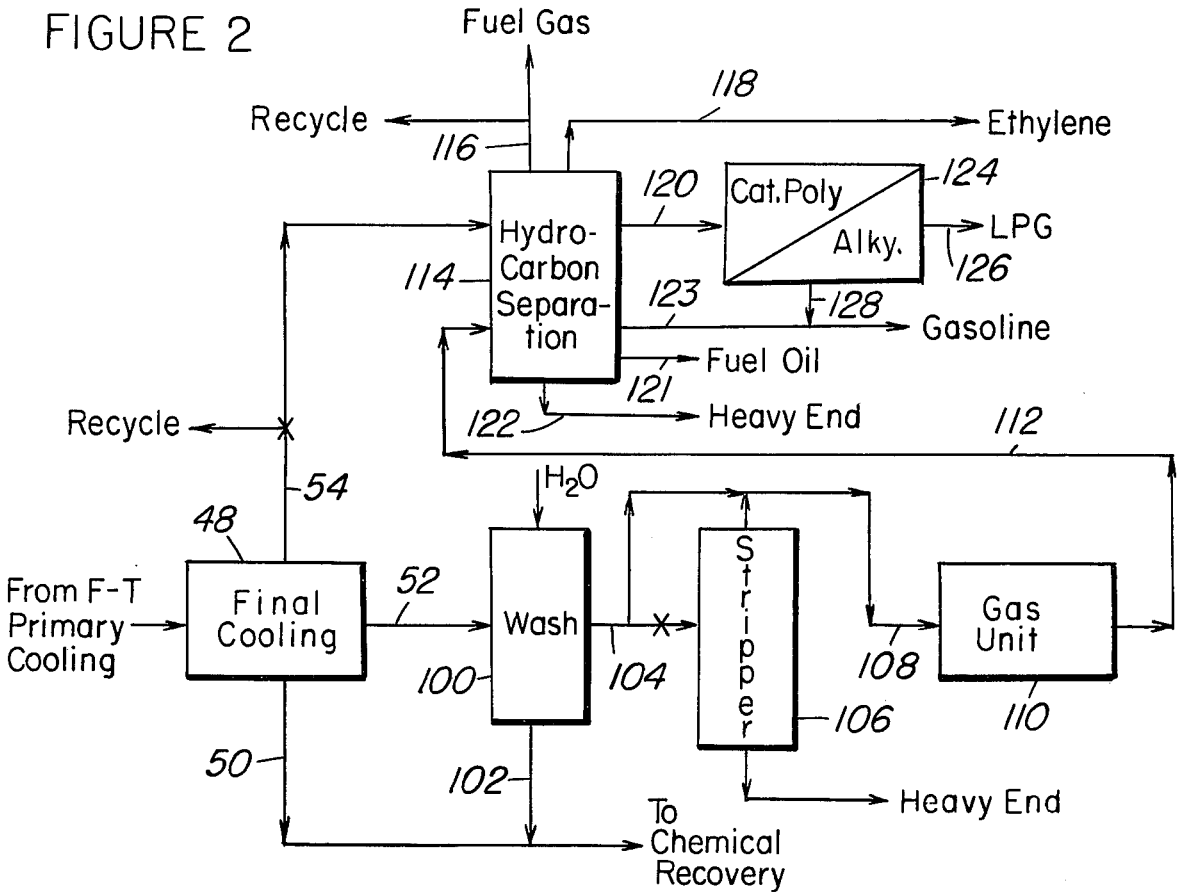
FIG. 2 is a diagrammatic sketch in elevation of a block flow arrangement for upgrading materials lower boiling than the decant oil phase separated from the final cooling step of FIG. 1.

Referrung now to FIG. 2 by way of example. The final cooling step 48 as discussed in FIG. 1 separates a water phase containing oxygenates withdrawn by conduit 50 from a light oil phase boiling below 560° F withdrawn by conduit 52 and a gaseous phase comprising $C_5$ and lower boiling components withdrawn by conduit 54. The gaseous phase comprising vaporous hydrocarbons withdrawn by conduit 54 has been identified as provided in Table 1 below.

TABLE 1

| | |
|---|---|
| Mol % $N_2$ | 14 |
| $H_2$ | 30 |
| CO | 2 |
| $CO_2$ | 17 |
| $CH_4$ | 26 |
| ($C_2$-$C_4$) | 9 |
| $C_5$+ | 2 mol % |

The light oil fraction withdrawn by conduit 52 boils within the range of about $C_5$ up to about 560° F and contains some entrained oxygenates not removed as by the primary and final cooling steps discussed in FIG. 1. This light oil fraction is passed to a further water wash step 100 which may include caustic wash to remove additional entrained oxygenates withdrawn by conduit 102 and combined with the water phase in conduit 50. This recovered water phase is passed to chemical recovery not shown. It is contemplated bypassing this washing step in zone 100 when it is desired to convert entrained oxygenates to hydrocarbon product. The oxygenates comprising the water phase have been identified as comprising the following materials.

ORGANIC CHEMICALS

Acetaldehyde
Propionaldehyde
n-Butyraldehyde
Acetone
Methanol
Methyl ethyl ketone
Ethanol
n-Propyl alcohol
n-Butyl alcohol
n-Amyl alcohol
Acetic acid
Propionic
Butyric acid
Methyl propyl ketone It is contemplated in one embodiment of this invention of converting oil or a portion of the recovered oxygenates to chemicals. On the other hand in the event that an excess of the lower alcohols is available from the process, it is further contemplated converting these lower alcohols to hydrocarbons in the gasoline boiling range by contacting the special zeolite catalyst herein identified under these conditions particularly promoting the conversion. Conversion of the alcohols alone or in the presence of other recovered oxygenated products may be accomplished with either of the $C_5$ rich vaporous material recovered and processed as hereinafter described with respect to FIG. 3 or these materials may be processed with gasoline fraction discussed with respect to FIG. 2.

The light oil phase withdrawn by 104 is then passed to a separation zone 106. The separation zone 106 may be a stripping zone wherein the light oil phase is separated to recover a synthetic gasoline boiling material from a higher boiling light fuel oil phase. It is thus contemplated vary the yields of the respective components by selecting a cut point from within the range of about 350° F to about 560° F. Thus, a synthetic gasoline may be recovered with an end point of only about 330° F or it may be as high as about 400° F or 430° F. When maximizing the yield of light fuel oil in this separation step, the gasoline end point will be reduced to a lower end of the scale and as low as about 330° or 340° F. Thus depending on the results desired, the stripping-separation zone 106 may be used or completely bypassed. The light-oil phase comprising $C_5$ plus hydrocarbons obtained as above provided is then passed by conduit 108 to a catalytic reaction section or zone 110. Reaction zone 110 contains a mass of the special crystalline zeolite catalyst herein identified and selected from the class of crystalline zeolites represented by ZSM-5 crystalline zeolite. Reaction zone 110 may be mixed or fluid catalyst bed reaction zone maintained at a temperature within the range of 500° F to about 950° F. The temperature conditions employed will vary slightly with the end point of the material being processed therein. In this catalytic reaction zone maintained at a pressure within the range of 0 to 300 psig the octane rating of gasoline boiling material recovered therefrom is considerably raised and may be as high as 95 octane. The product of catalytic upgrading in zone 110 is passed by conduit 112 to a hydrocarbon separation section 114 comprising more than one product separation zones. Gaseous material withdrawn from final cooling zone 48 by conduit 54, is passed all or in part to the hydrocarbon separation section 114. In this separation section, the products are separated to recover a $C_2$ minus hydrogen containing gaseous material withdrawn by conduit 116, an ethylene fraction recovered by conduit 118, a gaseous fraction rich in $C_3$ and $C_4$ hydrocarbons and suitable for processing through catalytic polymerization or alkylation withdrawn by conduit 120, a $C_5$ plus gasoline product fraction withdrawn by conduit 123, a light fuel oil fraction withdrawn by conduit 121, and a higher boiling fuel oil fraction withdrawn by conduit 122. The gaseous fraction rich in $C_3$-$C_4$ hydrocarbons in conduit 120 is passed to zone 124 which may be either a catalytic polymerization zone or an alkylation zone. LPG (liquified petroleum gas) product gases are recovered by conduit 126 and gasoline boiling range material is recovered by conduit 128.

In the arrangement comprising FIG. 1, it is also contemplated improving the material boiling below about 650° F and separated from the decant oil fraction by processing this material along with the separated light oil by contact with the special crystalline zeolite catalyst provided as in conversion zone 110. Thus, the material in conduit 94 of FIG. 1 would be mixed with the material in conduit 108 of FIG. 2. In this embodiment, the yield of high octane gasoline can be considerably increased.

Figure 3:
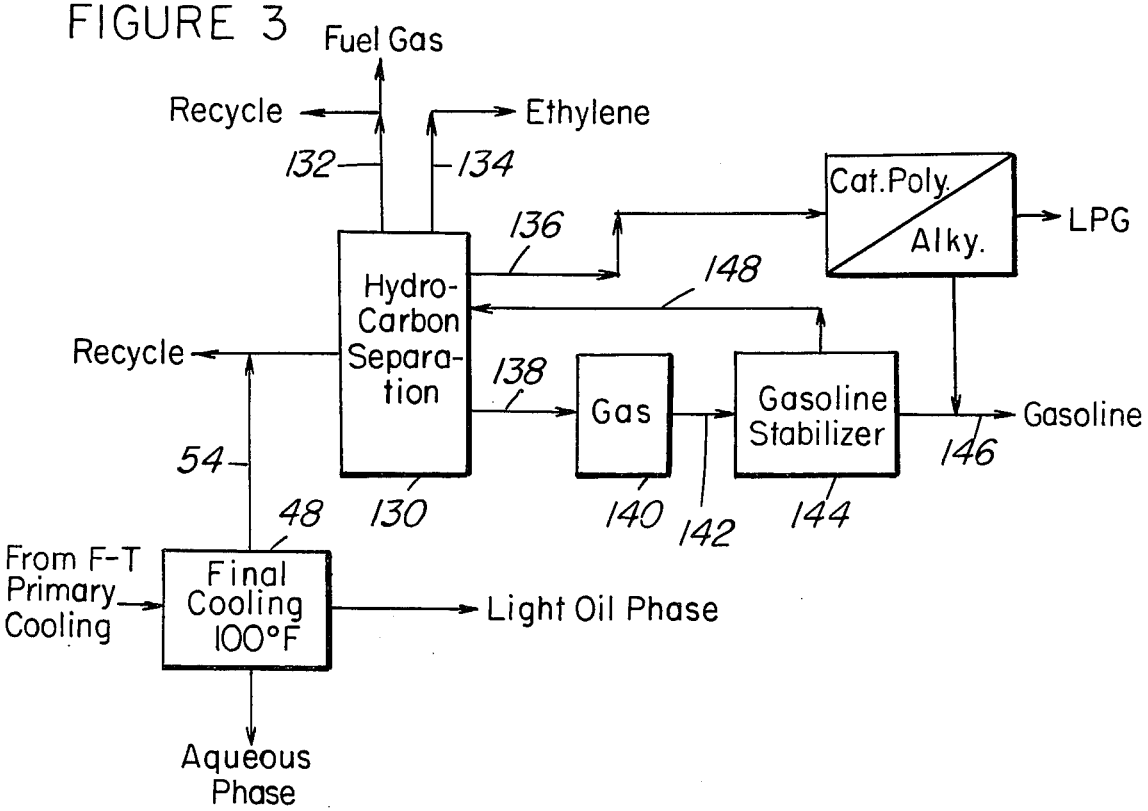
FIG. 3 is a diagrammatic sketch in elevation of a block flow arrangement for upgrading materials lower boiling than the light oil phase separated from the final cooling step of FIG. 1.

In the arrangement of FIG. 3, the product effluent of the primary cooling zone boiling below the decant oil fraction as described with respect to FIG. 1 is passed to the final cooling zone 48 maintained at a temperature of about 100° F. In the final cooling zone 48, a vaporous material comprising $C_5$ and lower boiling components such as identified in table 1 above is withdrawn. As known in the art, the Fischer-Tropsch synthesis operation produces a considerable amount of paraffin and olefin hydrocarbons and particularly $C_5$ hydrocarbons which are absorbed in part in the light oil and decant oil phases roughly separated as discussed above. Thus less than about half of the $C_5$ hydrocarbons produced in the process are recovered in the final cooling step 48 as a vaporous stream separately removed therefrom by conduit 54 as shown and referred to in FIG. 1. In this particular embodiment represented by FIG. 3, the vaporous material withdrawn by conduit 54 and comprising $C_5$ and lower boiling hydrocarbons is conveyed to a hydrocarbon separation section 130 wherein separation is made to recover a light $C_2$ minus fuel gas stream withdrawn by conduit 132, an ethylene rich stream withdrawn by conduit 134, a gaseous fraction rich in $C_3$ and $C_4$ hydrocarbons and suitable for processing through catalytic polymerization or alkylation withdrawn by conduit 136, and a $C_5$ rich hydrocarbon stream withdrawn by conduit 138. The $C_5$ rich hydrocarbon stream in conduit 138 is passed in contact with a crystalline aluminosilicate (CAS) catalyst in reaction zone 140 and comprising the special crystalline zeolite of the class presented by ZSM-5 crystalline (zeolite) aluminosilicate. In zone 140, the $C_5$ rich material is passed in contact with the special zeolite catalyst retained therein as a fixed or fluid catalyst bed operation maintained at a temperature selected from within the range of 500° F to 950° F and a pressure within the range of 0 to 250 psig. During this processing of the $C_5$ rich vaporous material, reaction conditions are maintained which promote the formation of gasoline boiling component as by cyclization and alkylation to form aromatics and alkyl-aromatics as well as lower boiling gaseous products suitable as LPG fuel components. The product effluent of the crystalline zeolite conversion operation is passed by conduit 142 to a gasoline stabilization operation in zone 144 wherein a stabilized gasoline is produced and withdrawn by conduit 146. Gaseous products lower boiling than gasoline boiling material and particularly $C_4$ and lower boiling components are withdrawn by conduit 148 and passed to the hydrocarbon separation section 130 discussed above.

In the combination operation of this invention and particularly, the embodiment of FIG. 2, a light oil stream identified in Table 2 below and comprising material boiling below about 560° F and particularly comprising $C_5$ and higher boiling hydrocarbons are passed in contact with a ZSM-5 crystalline zeolite at a temperature of about 650° F and a pressure of about 0 psig at a space velocity of about 2 LHSV. The total product obtained in such an operation is identified in Table 2 and comprises a significant yield of high octane gasoline. It is also to be noted that a significant amount of isobutane is formed in this operation which can be separated and used in the alkylation step of the process.

TABLE 2

LIGHT OIL FROM A TYPICAL FISCHER-TROPSCH PROCESS (OVER MOBIL ZSM-5 TYPE CATALYST)

| Yield, Wt % | 560° F EP Light Oil Charge | Total Product |
|---|---|---|
| CO, $CO_2$ $H_2$ | — | 0.1 |
| Water | — | 2.1 |
| Coke | — | 0.3 |
| Light Gas ($C_1 + C_2$) | — | 0.3 |
| Propane | .05 | 2.3 |
| Propylene | .23 | 1.4 |
| n-Butane | .20 | 2.6 |
| i-Butane | .02 | 5.5 |
| Butenes | 1.40 | 4.1 |
| $C_5$-425° F | 73.20 | 68.2 |
| 425° F and Heavier | 24.90 | 13.1 |
| Total | 100.00 | 100.0 |
| Octane No. (R+O) | | |
| Gasoline ($C_5$-425° F) | 55 | 92 |
| Oxygen, Wt % | 1.7 | <0.1 |
| Acid Number, mg KOH/gm | 5 | <0.05 |

In the embodiment represented by FIG. 3 above discussed, a $C_5$ plus vaporous stream identified in Table 3 below separated in the final cooling zone 48 at a temperature of about 100° F from liquid material and further separated in zone 130 is passed by conduit 138 to a reaction zone housing a mass of ZSM-5 crystalline zeolite maintained at a temperature of about 650° F and a pressure of about 0 psig. The $C_5$ plus vaporous fraction is converted during contact with the ZSM-5 catalyst to a product identified in Table 3 below. It is to be observed that high yield of 90–95 R+O $C_5$ plus material is formed.

TABLE 3

ESTIMATED YIELD AND OCTANE NUMBER OF $C_5$ + HYDROCARBONS IN VAPOR PHASE AFTER COOLING OF A FISCHER-TROPSCH RAW PRODUCT STREAM (OVER MOBIL ZSM-5 TYPE CATALYST)

| Yield, Wt % | Charge | Product |
|---|---|---|
| Coke | — | 0.3 |
| $H_2 + CO + CO_2$ | — | 0.1 |
| $CH_4 + C_2$ | — | 0.3 |
| $C_3$ | — | 2.3 |
| $C_3$= | — | 1.4 |
| n-$C_4$ | — | 2.6 |
| i-$C_4$ | — | 5.5 |
| $C_4$= | — | 4.1 |
| $C_5$+ | 100.0 | 83.4 |
| Total | 100.0 | 100.0 |
| R+O, $C_5$+ | 55–70 | 90–95 |

Having, thus, generally described the invention and provided specific examples in support thereof, it is to be understood that no undue restrictions are to be imposed by reason thereof except as defined by the following claims:

We claim:

1. A method for upgrading Fischer-Tropsch synthesis products boiling below about 560° F which comprises cooling and separating at a temperature of about 100° F a Fischer-Tropsch synthesis product boiling below about 560° F into a gaseous phase, a water phase and a hydrocarbon phase, water washing said hydrocarbon phase to recover oxygenates and combining the water phase above obtained for chemical processing, passing said hydrocarbon phase in contact with a crystalline aluminosilicate zeolite conversion catalyst that has a pore size greater than about 5 Angstroms; a silica to alumina ratio of at least 12; and a constraint index within the range of 1 to 12 under temperature conditions selected from within the range of 500° to 950° F and a pressure selected from within the range of 0 to 300 psig to produce a gasoline product of improved octane rating, separating the product of said crystalline zeolite conversion operation and said synthesis product gaseous phase under conditions to recover an ethylene rich fraction, a gaseous components fraction suitable for conversion to gasoline boiling materials, a gasoline fraction of improved octane rating, a light fuel oil fraction and a heavier oil fraction.

2. The method of claim 1 wherein the gaseous components fraction is processed through one of polymerization or alkylation to form gasoline boiling materials.

3. The method of claim 1 wherein the gaseous phase separated from the Fischer-Tropsch synthesis product is separated to recover a $C_5$ fraction separate from a $C_3$-$C_4$ rich fraction, said $C_5$ rich fraction is separately processed over said crystalline zeolite conversion catalyst under conditions forming gasoline boiling range material and the products of said $C_5$ rich conversion operation are separated to recover gasoline boiling materials from lower boiling components.

4. The method of claim 3 wherein a $C_3$-$C_4$ rich hydrocarbon phase is recovered from the Fischer-Tropsch synthesis gaseous phase and the products of $C_5$ conversion and thereafter subjected to one of catalytic polymerization or alkylation to form additional gasoline boiling materials and LPG products.

* * * * *

UNITED STATES PATENT AND TRADEMARK OFFICE

CERTIFICATE OF CORRECTION

PATENT NO. : 4,041,094

DATED : August 9, 1977

INVENTOR(S) : JAMES C. KUO, CHARLES DWIGHT PRATER and JOHN J. WISE

It is certified that error appears in the above-identified patent and that said Letters Patent are hereby corrected as shown below:

| | |
|---|---|
| Column 3, line 11 | "yeilds" should be -- yields --. |
| Column 7, line 22 | "Thr" should be -- The --. |
| Column 7, line 24 | Delete "a". |
| Column 9, line 13 | After "%" insert -- based --. |
| Column 9, line 23 | "434°" should be -- 424° --. |
| Column 14, line 8 | After "$C_5$" insert -- rich --. |

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*